US005466180A

United States Patent [19]

Hassler et al.

[11] Patent Number: 5,466,180

[45] Date of Patent: Nov. 14, 1995

[54] PROCESS AND DEVICE FOR MAGNETIZING A MAGNET RING IN THE NECK OF A COLOR PICTURE TUBE

[75] Inventors: Joachim Hassler; Rudi Lenk; Michael Neusch, all of Esslingen, Germany

[73] Assignee: Nokia Technology GmbH, Pforzheim, Germany

[21] Appl. No.: 72,834

[22] Filed: Jun. 7, 1993

[30] Foreign Application Priority Data

Jun. 13, 1992 [DE] Germany ..... 42 19 517.9

[51] Int. Cl.[6] ..... H01J 9/42

[52] U.S. Cl. ..... 445/3; 445/63

[58] Field of Search ..... 445/3, 4, 63, 64

[56] References Cited

U.S. PATENT DOCUMENTS

| | | | |
|---|---|---|---|
| 4,105,983 | 8/1978 | Barten et al. | 335/212 |
| 4,220,897 | 9/1980 | Barten et al. | 315/368 |
| 4,551,748 | 11/1985 | Mattle | 358/10 |
| 4,636,694 | 1/1987 | De Paolis et al. | 315/368 |
| 4,662,853 | 5/1987 | Van Veldhoven | 445/3 |

FOREIGN PATENT DOCUMENTS

| | | |
|---|---|---|
| 0123612 | 10/1984 | European Pat. Off. . |
| 2306522 | 10/1976 | France . |
| 2611633 | 10/1976 | Germany . |
| 2828710 | 1/1979 | Germany . |
| 3206913 | 9/1983 | Germany . |
| 2000635 | 1/1979 | United Kingdom . |

*Primary Examiner*—Kenneth J. Ramsey

*Attorney, Agent, or Firm*—Ware, Fressola, Van Der Sluys & Adolphson

[57] ABSTRACT

A calibration step is carried out on a calibration tube in which magnetizations which cause beam displacements in x and y directions are determined for all the magnet poles and beams, and the adjustments of sensitivity of each beam from the x/y values is determined. A beam deviation of a production tube is then adjusted by determining its initial error in x and y directions and then starting a calculation sequence in which the magnetization currents are calculated by linear superposition of the individual currents on the basis of the known adjustment sensitivities. An additional rotating and decreasing auxiliary field is active during the magnetization of the poles in the rings of the calibration tube and of the production tube. It is also possible to correct twist errors using the invention.

20 Claims, 11 Drawing Sheets

(1), (2), (4): YRTV_A/YRTV_M=FV (1)

(3), (5): YRTV_A-YRTH_A=YRT (1), (4), (6): YRTV_M-YRTH_M=0

YRTH_A=YRTV_A x (FH/FV)

YRTV_A=YRT x (1-FH/FV)

YRTH_M=(YRT/FV) x (1-FH/FV)

YRTH_A/YRTH_M=FH (2)

(3)

(4)

(5)

(6)

(7)

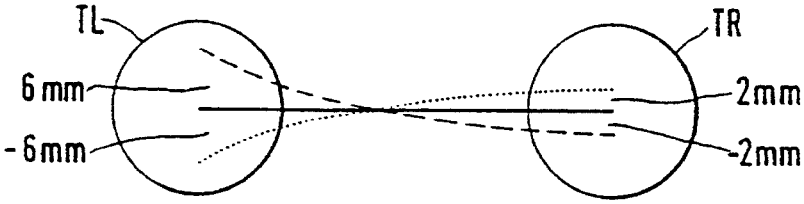
FIG. 10A
(PRIOR ART)
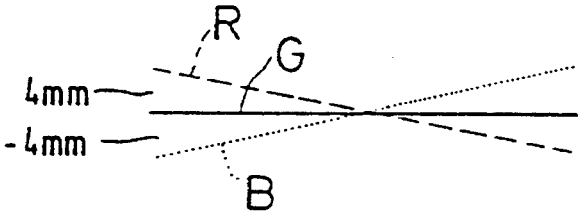
FIG. 10B
(PRIOR ART)
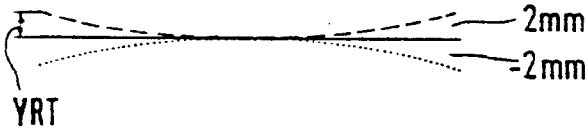
FIG. 10C
(PRIOR ART)
FIG. 12A
(PRIOR ART)
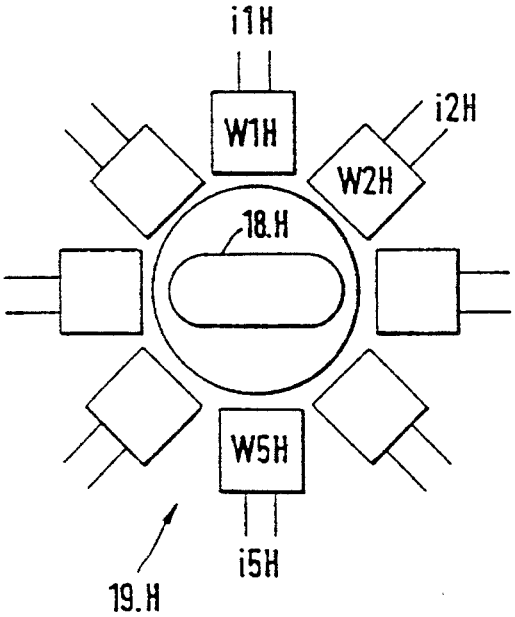
FIG. 12B
(PRIOR ART)
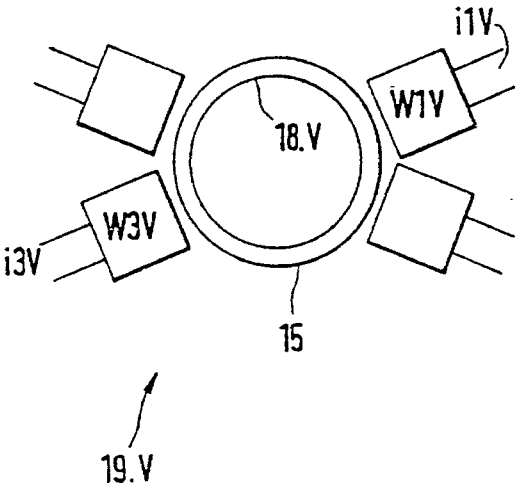

PROCESS AND DEVICE FOR MAGNETIZING A MAGNET RING IN THE NECK OF A COLOR PICTURE TUBE

TECHNICAL FIELD

The following concerns a process and a device for magnetizing a magnet ring in the neck of a color picture tube with a plurality of electron beams.

BACKGROUND OF THE INVENTION

Definitions

Throughout what follows, reference will be made to tubes of the "in-line" type, in which three electron beams are generated in one horizontal plane. However, what follows also applies correspondingly to "delta-gun" tubes.

Because of tolerances, discrepancies occur in the manufacture of color picture tubes between the actual beam position and the reference position. These are static errors (which are present regardless of the properties of a deflector), and dynamic errors (which are caused by the deflector). In what follows, only the static errors are of interest; these are: targeting (color purity), vertical raster position, convergence, and twist. These errors are explained below. They are measured at various points of a screen 10 as depicted schematically in FIG. 7. Convergence and vertical raster position are measured at the center of the screen, as illustrated by a circle labeled KV in FIG. 7. This circle represents, for example, the field of view of a microscope. Measurement points for targeting measurements are labeled LL and LR, while measurement points for the twist measurements carry the designations TL and TR.

FIG. 8 illustrates a raster pattern as visible inside the circle KV. The three electron beams of the tube generate three cross-shaped bar patterns, labeled R, G, and B. For convergence, the cross-shaped bar patterns must essentially coincide. In addition, their horizontal bars should essentially coincide with the horizontal center line H of the tube. In the example of FIG. 8, the three horizontal bars each deviate from the horizontal center line H by values YR, YG, and YB, respectively. A corresponding depiction would consist in indicating the deviation of the green horizontal bar from the horizontal center line, and deviations of the red and blue horizontal bars from the green horizontal bar. The red and blue vertical bars are located at distances XRGK and XBGK, respectively, from the vertical green bar. All deviations can typically be up to several millimeters.

FIGS. 9*a* and 9*b* illustrate what is visible inside the circles LL and LR, respectively. In this case the resolution is much finer than in the measurement illustrated by FIG. 8. Specifically, what is being observed is not macroscopic pattern bars, but targeting spots 11 on phosphor stripes 12. At the measurement point LL, the center MSL of the luminous spot 11 is offset 40 μm to the left compared with the center MDL of the phosphor stripe 12. At measurement point LR, however, the corresponding centers MSR and MDR coincide. To adjust the targeting, the electron beams are displaced so that all the luminous spots move 20 μm to the right, so that the luminous spots at measurement point LL are displaced 20 μm to the left with respect to the center of the phosphor stripe, while on the right a corresponding displacement to the right is produced. To produce this 20 μm displacement in targeting, the electron beams must be displaced a few millimeters by means of a static magnetic field in the tube neck.

The aforesaid targeting example clearly shows that a distinction must be made between "beam deviation" and "beam displacement." In what follows, "beam deviation" will be understood to mean deviation from a reference position. "Beam displacement" is understood as the distance by which an electron beam must be displaced on the screen 10, by means of a magnetic field generated in the tube neck, in order to achieve a desired position. This does not immediately need to be the reference position, but may be an intermediate position.

FIGS. 10*a* to 10*c* serve to illustrate the twist error mentioned earlier. FIG. 10*a* depicts what is visible at measurement points TL and TR. The resolution corresponds to that of FIG. 8, and is therefore such that pattern lines R, G, and B can be observed. It is evident that on the left, line R is located above line G, but on the right is below this line, and that the spacing on the left is greater than on the right. Line B is located symmetrically with respect to line R. FIGS. 10*b* and 10*c* illustrate that this error is composed of a crossover error (FIG. 10*b*) and of the twist error itself (FIG. 10*c*). The individual influences of the two errors can be determined by the two measurements at the points TL and TR.

To conclude the definition of terms, it should be mentioned that "calibration tubes" and "production tubes" will be discussed in what follows. A calibration tube is understood to be any tube which is used to test the sensitivity of a magnetizing device for the adjustment of a magnetizing unit. A production tube, on the other hand, is a tube of the same type on which the errors explained above are measured, and in which a magnet ring is then magnetized by means of a magnetic field that is determined on the basis of the calibration data and the measured deviations. For highly precise adjustments, each individual tube can be used first as a calibration tube and then as a production tube, in each case as explained above. As a rule, however, a magnetizing device is calibrated with the aid of only one tube, and the values obtained with that tube are then applied to many production tubes.

PRIOR ART

FIG. 11 shows a magnetizing device on a color picture tube 13, that has an electron beam generating system 14 (indicated only schematically) in the tube neck 15, and a deflector 16. The electron beam generating system 14 and the deflector 16 are driven by a tube driver 17. Located in front of the screen 10 of the color picture tube are five measurement arrangements bearing the same designations as the measurement points in FIG. 7. The readings obtained from these measurement arrangements are collectively designated MW.

Fastened to the electron beam generating system 14 are a rear magnet ring 18.H and a front magnet ring 18.V. Typically the rear magnet ring 18.H is located approximately at the center of the "focusing grid," while the front ring 18.V is located at the base of the "convergence pot." The purpose of the front ring is to correct the twist error, and that of the rear ring is to correct the other errors mentioned above. Instead of two rings, there can also be a band that is magnetized in two planes that are separated from one another. Many tube manufacturers also completely omit correction of the twist error, and accordingly use only one magnet ring.

The device for magnetizing, for example, the rear magnet ring 18.H is known, for example, from U.S. Pat. No. 4,105,983, and possesses the following:

a magnetizing unit 19.H, and a calibration arrangement 20 to determine, with the aid of a calibration tube, which currents through the magnetizing unit cause which beam displacements;

a calculation arrangement 21 to calculate magnetizing currents for the magnetizing unit on the basis of the readings MW and the calibrated values, so that magnetization of the magnet ring by means of the magnetizing currents will deflect the beams into the reference positions; and a driver device 22.H to drive the magnetizing unit 19.H.

Also present are a calibration data memory 23, a rotary field generating arrangement 24, and a sequence controller 25.

To magnetize the front magnet ring 18.V, a front magnetizing unit 19.V that is driven by a driver 22.V is present.

FIGS. 12*a* and 12*b* illustrate the structure of the rear magnet unit 19.H and front magnet unit 19.V, respectively. The rear magnet unit has eight coils W1H to W8H, each of which can be individually driven by an associated current i1H to i8H. The eight coils lie in a plane perpendicular to the tube neck 15, at an angle of 45° from one another. The front magnetizing unit 19.V has four coils W1V to W4V, which also can be driven separately, each by an associated current i1V to i4V. All four coils again lie in a plane perpendicular to the tube neck 15, in a paired arrangement with each offset by +30° or −30° with respect to the horizontal plane. It is also evident from FIG. 12 that the rear magnet ring 18.H is typically oval, while the front magnet ring 18.V is typically round.

Also part of the magnetizing device is a display 26, on which can be displayed, for example, the readings MW and data related to the sequence implemented by the sequence controller 25.

In the practical operation of this device, as in all known devices, a clear distinction must be made between twist correction and correction of the other static errors. Specifically, twist correction is made manually, if at all, while the other corrections are performed automatically. To correct the twist, the user first examines all the errors, and then, when no further errors are present, applies the magnetizing current so that the magnetization of the front magnet ring 18.V resulting therefrom will precisely compensate for the twist error. If other errors are present, the user determines by experience how much to over- or undercorrect.

The other errors, however, are corrected with the following steps:

calibrate the magnetizing unit using a calibration tube, so as to determine which currents through the magnetizing unit cause which beam displacements;

measure deviations between beam positions and reference positions;

calculate magnetizing currents for the magnetizing unit based on the measured deviations and the calibration values, so that magnetization of the magnet rings using the magnetizing currents will deflect the beams into the reference positions; and magnetize the magnet ring using the magnetizing currents.

Deviations between beam positions and reference positions can be measured by the user with a measurement microscope, after which the user enters the readings into the calculation arrangement 21, or the readings can be automatically recorded, as described for example in U.S. Pat. No. 4,551,748.

The magnetization sequence listed above is known, for example from U.S. Pat. No. 4,105,983 in which currents to generate 2-, 4-, and 6-pole fields are defined in the calibration procedure. Measured beam deviations are accordingly converted into magnetizing currents to generate such fields. U.S. Pat. No. 4,220,897 indicates that in practice, such a process does not lead to usable results. To remedy this, a process is proposed which works without calibration, which applies currents through individual coils, and which impresses a magnetic field into a magnet ring using an auxiliary field. First the currents through individual coils of a magnetizing unit are set so that all beams occupy their respective reference positions. The currents determined in this manner are then multiplied by a factor, and the sign of the currents increased in this fashion is changed. Overlaid on the magnetization field generated in this manner is a rotary field of decaying amplitude, in other words a field whose position in time and space changes so that averaged over time, it acts essentially identically, with regard to impression of the applied magnetization field into the magnet ring, in all spatial directions of that field.

This process is disadvantageous in several ways. Firstly, it is very difficult to set the currents through the individual coils of the magnetizing unit so that all the beams occupy their respective reference positions, since a current through a coil often not only acts so that the magnetic field generated thereby displaces into its reference position an electron beam that still deviates from that reference position, but simultaneously acts so that an electron beam which is already correctly adjusted is displaced out of its reference position. Many current adjustment steps are therefore necessary in order ultimately to move all the electron beams essentially into their respective reference positions. A second problem is that unsatisfactory results can be produced if the same factor is used for all currents when converting applied currents into magnetizing currents.

DISCLOSURE OF INVENTION

The problem that existed was therefore to indicate a process and a device for magnetizing a magnet ring in the neck of a color picture tube that operate simply and accurately.

The process according to the invention possesses the steps listed above, and in addition a calibration arrangement is designed so that it performs the following calibration sequence:

operate the respective coil m with a calibration current im_KAL, in order to generate a calibration magnetizing field;

impress the magnetic field generated by the respective coil into the magnet ring by means of an auxiliary field that has essentially the same profile in time and space as one that is used to magnetize the magnet ring of a production tube;

measure the beam displacements Sn of all the electron beams for two directions perpendicular to one another, these beam displacements being produced by magnetization of the previously unmagnetized magnet ring;

calculate the adjustment sensitivity Emn for each electron beam, in each case for the two spatial directions perpendicular to one another, with Emn= Sn/im_KAL;

the measurement sequence consists in measuring the beam deviations of all the beams from a respective reference position, in the two spatial directions that are perpendicular to one another;

the calculation sequence for the magnetizing currents takes place by linear superimposition of the individual currents required, on the basis of the adjustment sensitivities, to move each of the beams into its reference position; and the magnetization sequence is performed by operating the coils with the calculated magnetizing currents in order to generate an applied magnetizing field; and generating an auxiliary field whose amplitude decreases over time and whose position in time and space changes so that averaged over time, the auxiliary field acts essentially identically in all spatial directions as the magnetizing field applied to magnetize the magnet ring of the production tube.

The device according to the invention has the arrangements listed above, which are designed so that they perform the process steps just mentioned.

The realization underlying the process and device in accordance with the invention is that currents determined during calibration can be linearly superimposed for later correction of errors, if calibration was performed with two factors in mind. The first is that magnetizations are impressed using an auxiliary field whose amplitude decreases over time, and whose position in time and space changes so that averaged over time, it acts essentially identically, with regard to impression of the calibration or applied magnetizing field into a magnet ring, in all spatial directions of that field. This procedure is in itself known from U.S. Pat. No. 4,220,897. The other important factor is that calibration must occur under precisely the same conditions as subsequent measuring magnetization, in other words that the action of magnetizing fields on electron beams is not examined directly, but rather that a magnetization is impressed by means of the magnetizing currents and the auxiliary field, and then the influence of that magnetization on the beams is examined. The calibrating correlation between magnetizing currents and beam displacement is therefore only an indirect one.

The process according to the invention makes it possible for the first time to adjust the twist error automatically using two magnetizing units. The procedure for doing so is as follows:

during calibration, each of the two magnetizing units is examined to determine the extent to which a beam displacement in the y direction at an outer edge of the calibration tube, caused by magnetization of the magnet ring that was just magnetized, leads to displacement of that same beam in the y direction at the center of the tube;

an additional measurement is made on the production tube to determine how far a beam is deviating in the y direction from its reference position at one outer edge;

a determination is made as to how far that beam needs to be displaced in the y direction at the outer edge, by magnetizing the one magnet ring using the one magnetizing unit, so that after magnetization of both magnet rings, the beam occupies its reference position both at the outside and in the center;

the displacement in the y direction for the center resulting from this displacement at the outer edge is determined, using the calibration results for the purpose; and in calculating the applied currents for the other magnetizing unit, the aforesaid required beam displacements are not used directly; instead, values are used that are obtained by adding to these beam displacements for the respective beam the aforesaid resulting displacements in the y direction for the center.

Stated more graphically, this means that the magnetizing currents for the front magnetizing unit are calculated so that when the front magnet ring is magnetized, the positions of the outer electron beams are "aimed" ahead of their reference positions, and that "aiming lead" is canceled out when the rear magnet ring is magnetized.

These and other objects, features and advantages of the present invention will become more apparent in light of the detailed description of a best mode embodiment thereof, as illustrated in the accompanying drawing.

BRIEF DESCRIPTION OF THE DRAWING

Figures concerning the prior art (already described.

FIGS. 10*a, b, c:* Depictions to explain how a twist error is measured;

FIG. 11: Block circuit diagram of a color picture tube and a device for magnetizing a magnet ring in the neck of the tube; and FIGS. 12*a* and 12*b:* Schematic depictions of a rear and front magnetizing unit, respectively, arranged around the neck of the tube in FIG. 11.

BEST MODE FOR CARRYING OUT THE INVENTION

Figure 1:
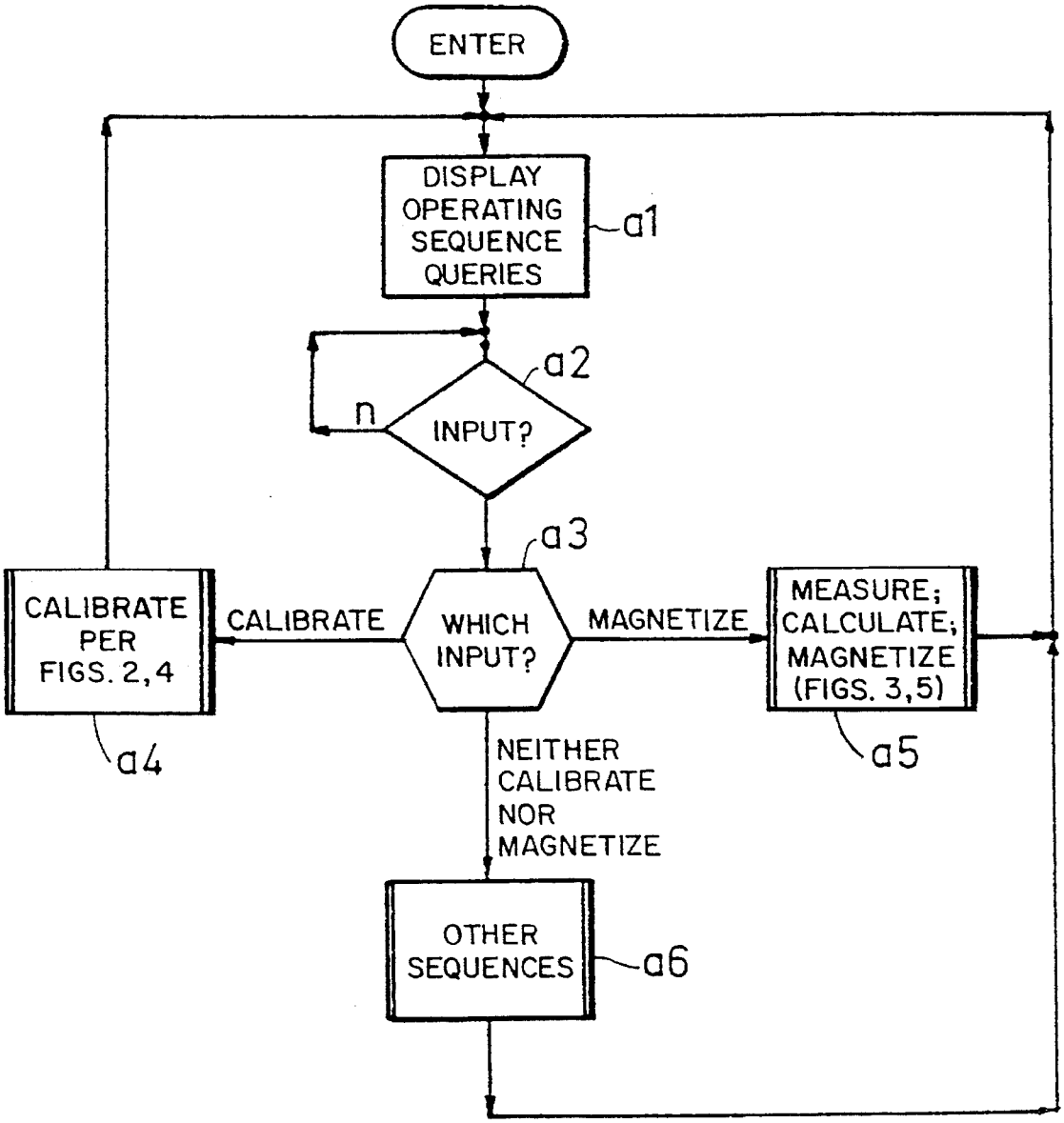
FIG. 1: Flow diagram providing an overview of an entire exemplary embodiment of the process according to the invention.

In accordance with the general sequence illustrated in FIG. 1, in a step a1 the sequence controller 25 displays an operating mode query on the display 26. As soon as an input has been made, which is determined in a step a2, the type of input is examined in a step a3. If calibration is selected, a calibration subprogram a4 executes, as illustrated further in FIGS. 2 and 4. Step a1 is then reached again. If magnetization is selected, however, a magnetization subprogram a5 executes, as illustrated further by FIGS. 3 and 5. After this subprogram is complete, step a1 once again follows. If neither calibration nor magnetization is selected by the input, other sequences are executed in a subprogram a6, for example the entire process is terminated. Otherwise the sequence returns to step a1.

The process according to this summary sequence can be changed in many ways. For example, the magnetization subprogram a5 can be executed repeatedly until it is interrupted by a key input. This makes it possible to process one production tube after another without having to select the magnetization sequence each time.

Figure 2:
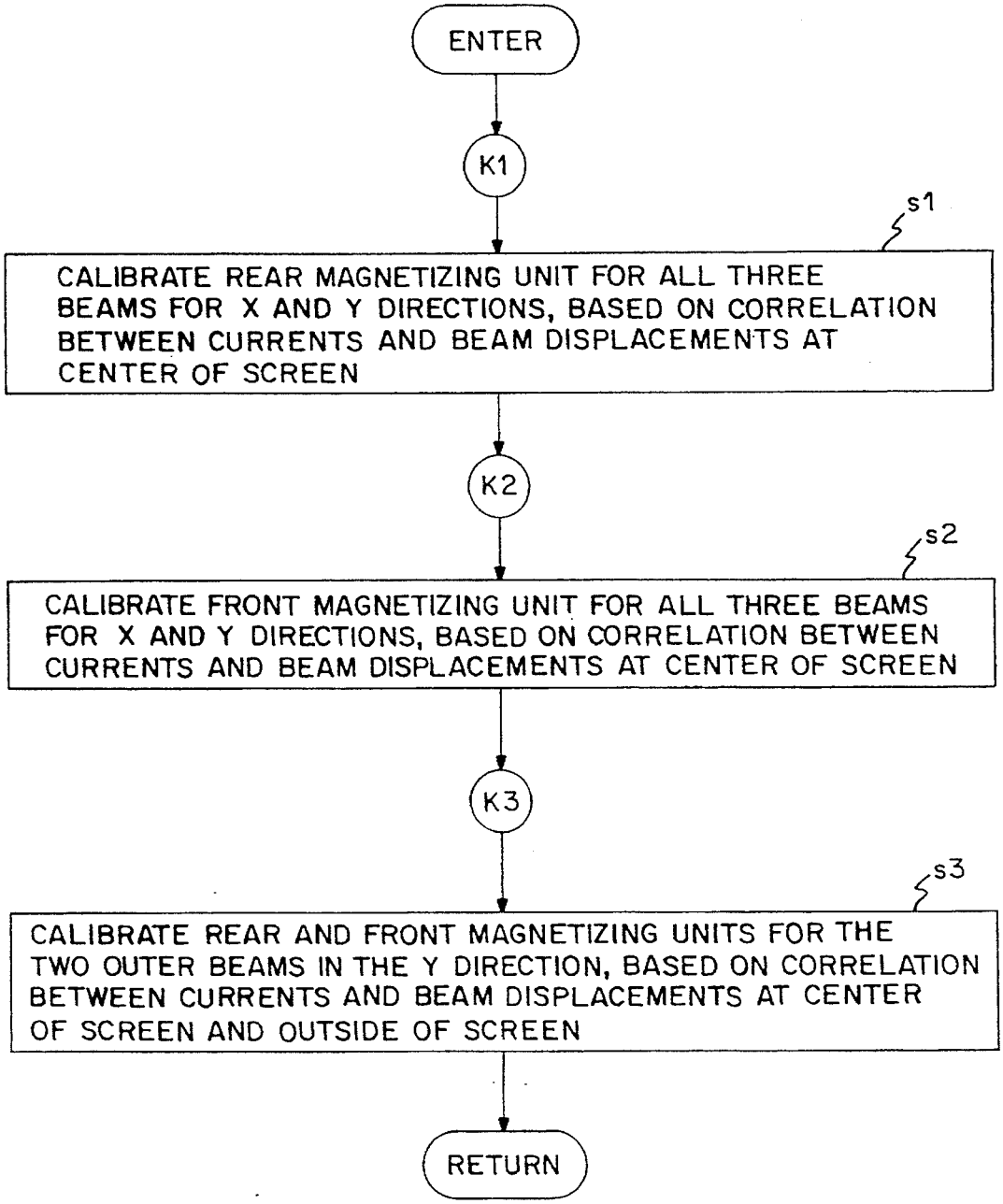
FIG. 2: Flow diagram to illustrate the general sequence of a calibration process according to the invention.
Figure 4A:
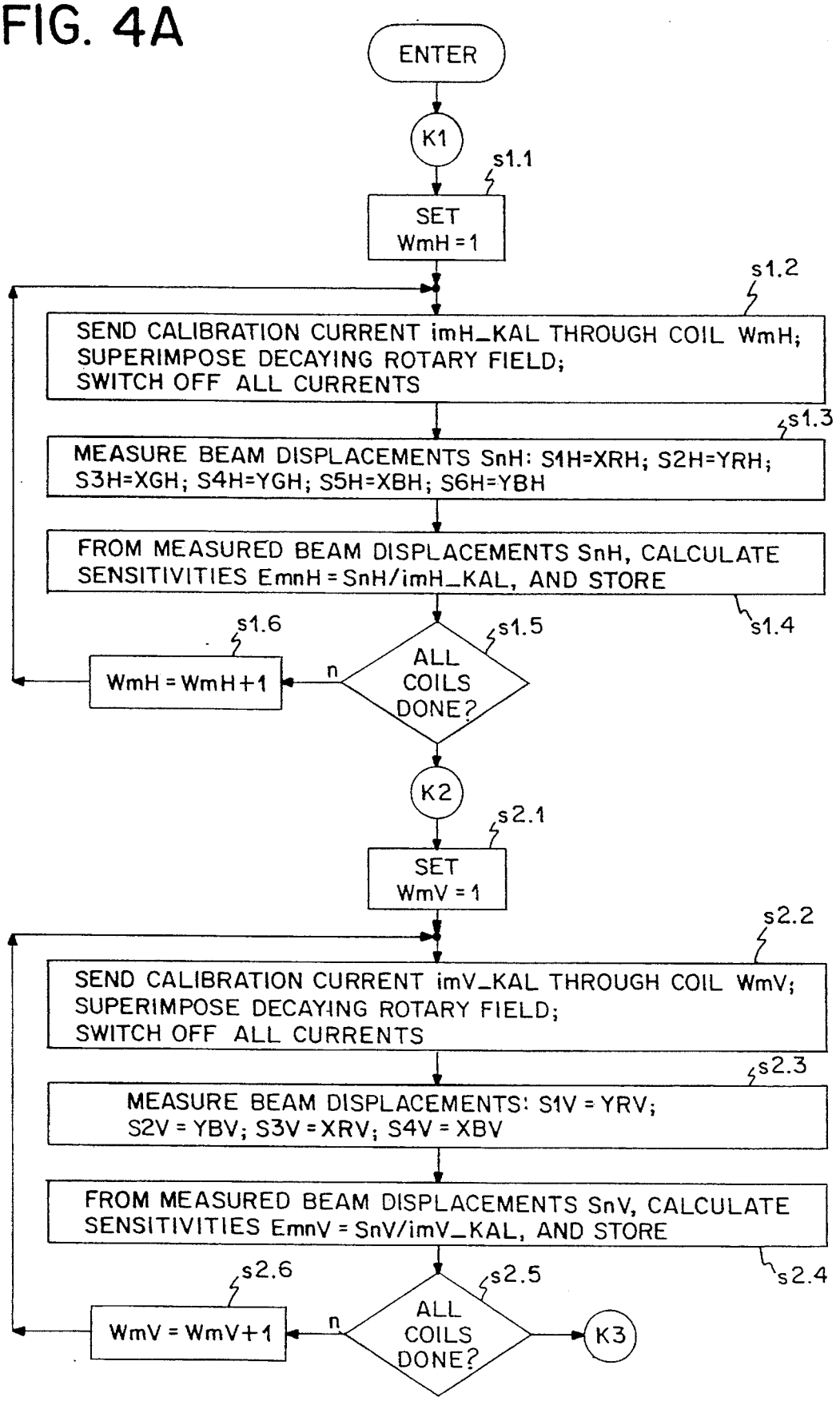
FIGS. 4*a* and 4*b:* Detailed flow diagram for the sequence according to FIG. 2.

The flow diagram according to FIG. 2 has three markers K1, K2, and K3, each preceding to a step s1, s2, and s3 respectively; these steps between the markers are designed to illustrate in summary the more detailed program of FIG. 4*a*. Since these steps are labeled in detail in FIG. 2, reference will be made to this Figure when discussing their content. Represented are three calibration steps, specifically for the rear magnetizing unit, the front magnetizing unit, and the two magnetizing units together, with reference to an interaction that occurs in correcting for twist.

Figure 3:
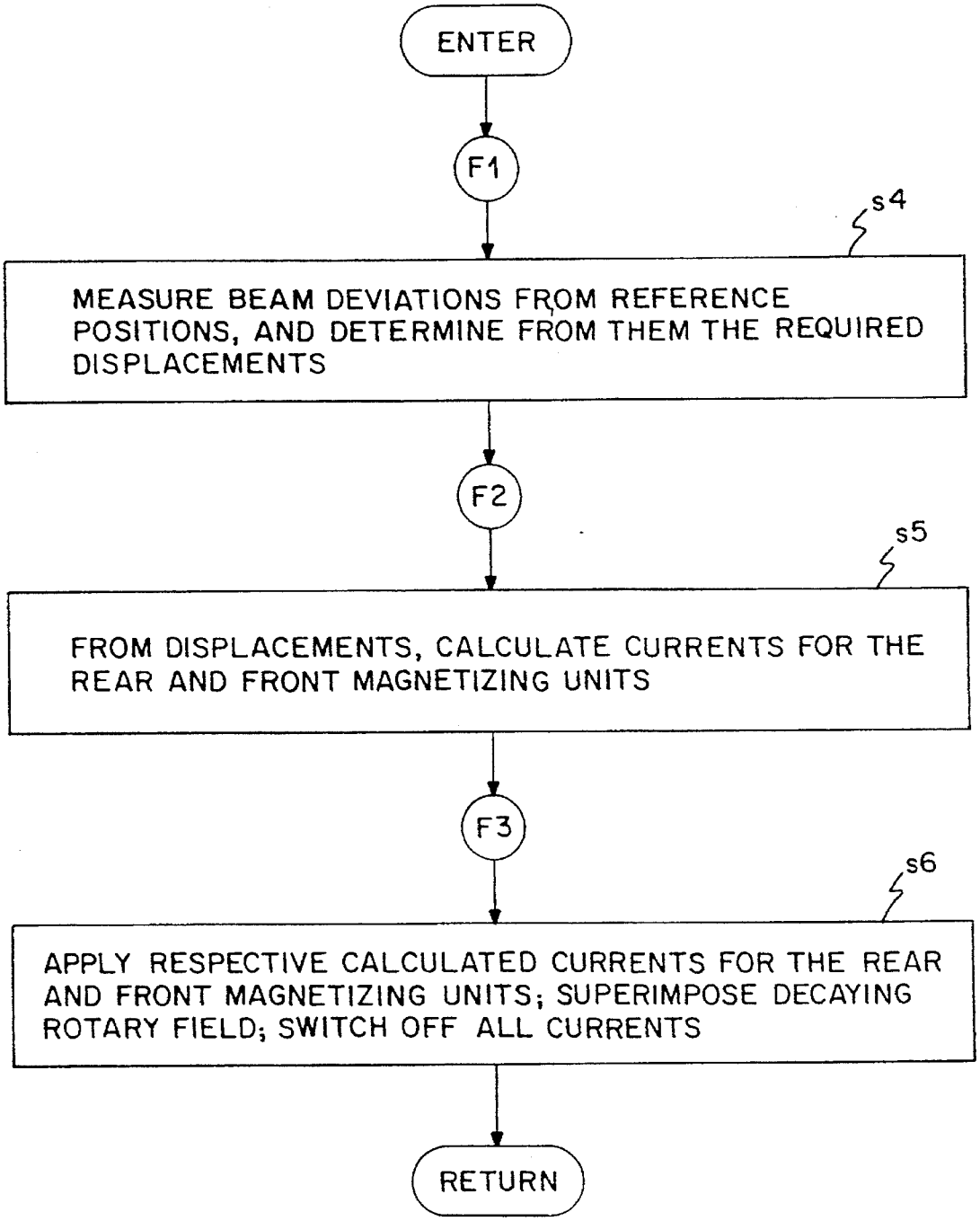
FIG. 3: Flow diagram to illustrate the general sequence of magnetizing two magnet rings to compensate for errors according to the invention.

Drawn in the flow diagram in FIG. 3 are three markers F1, F2, and F3, preceding steps s4, s5, and s6, respectively; in the same way as FIG. 2, these markers are intended to facilitate orientation in the more detailed flow diagram of FIG. 5. Represented is a sequence for measuring beam deviations, for calculating magnetizing currents, and for impressing a magnetization into a magnet ring. When discussing the detailed sequence, reference will be made to the steps s4 to s6 labeled in detail in FIG. 3.

Step s1 of FIG. 2 is subdivided in FIG. 4*a* into six individual steps s1.1 to s1.6. In step s1.1, the continuous numbering for the rear coils WmH (see FIG. 12*a*) is set to a value of 1. Then a predefined calibration current imH_KAL, for example a current of 1 A, is sent through the coil WmH, and a decaying rotary field that, for example, decreases in 100 steps from 40 A to 5 A is superimposed on this current. As soon as the low value for the amplitude of the rotary field is reached, the rotary field and the calibration current are switched off (step s1.2). Once the rear magnet ring 18.H has been magnetized by means of the sequence just described, beam displacements SnH are measured in step s1.3, with the value n ranging from 1 to 6, i.e. for the three electron beams R, G, and B and the two spatial directions x and y perpendicular to one another. From the six measured beam displacements, sensitivities EmnH= SnH/imH_KAL are calculated and stored (step s1.4). Then (step s1.5) the program examines whether the sequences of steps s1 to s4 have already been completed for all eight coils in the rear magnetizing unit 19.H. Since this is not yet the case, a step s1.6 is reached, in which the coil number m is increased by 1, after which steps s1.2 to s1.4 are executed again. The coil number is increased in this manner until calibration has been completed for all eight coils of the rear magnetizing unit.

Just as step s1 is subdivided in FIG. 4*a* into six steps s1.1 to s1.6, step s2 of FIG. 2 is subdivided into six steps s2.1 to s2.6, which essentially differ from steps s1.1 to s1.6 only in that calibration steps are executed for the four front coils W1V to W4V. What is measured in step s2.3, however, is not six beam displacement values, as in step s1.3, but only four, i.e. only for the two outer beams R and B and for the two spatial directions x and y. If the four coils W1V to W4V could be constructed in practice so that they acted precisely identically, it would be sufficient to make only a single measurement in the y direction, for example the displacement of the beam R. However, since the four coils in practice act slightly differently, four different magnetization currents must be calculated, requiring four measurements. For this purpose, any four variables can be selected from the total of six available, namely the deviations for the three beams in the two coordinate directions, although at least one measurement for an outer beam in the y direction must be present. The reason is that calibration between the K2 and K3 markers is performed with reference to later twist correction, i.e. to an error that is perceptible in the y direction. Thus it is also necessary to make the measurements according to step s2.3 at an outer edge of the calibration tube, while the measurements according to step s1.3 are made at the center of the tube.

Figure 4B:
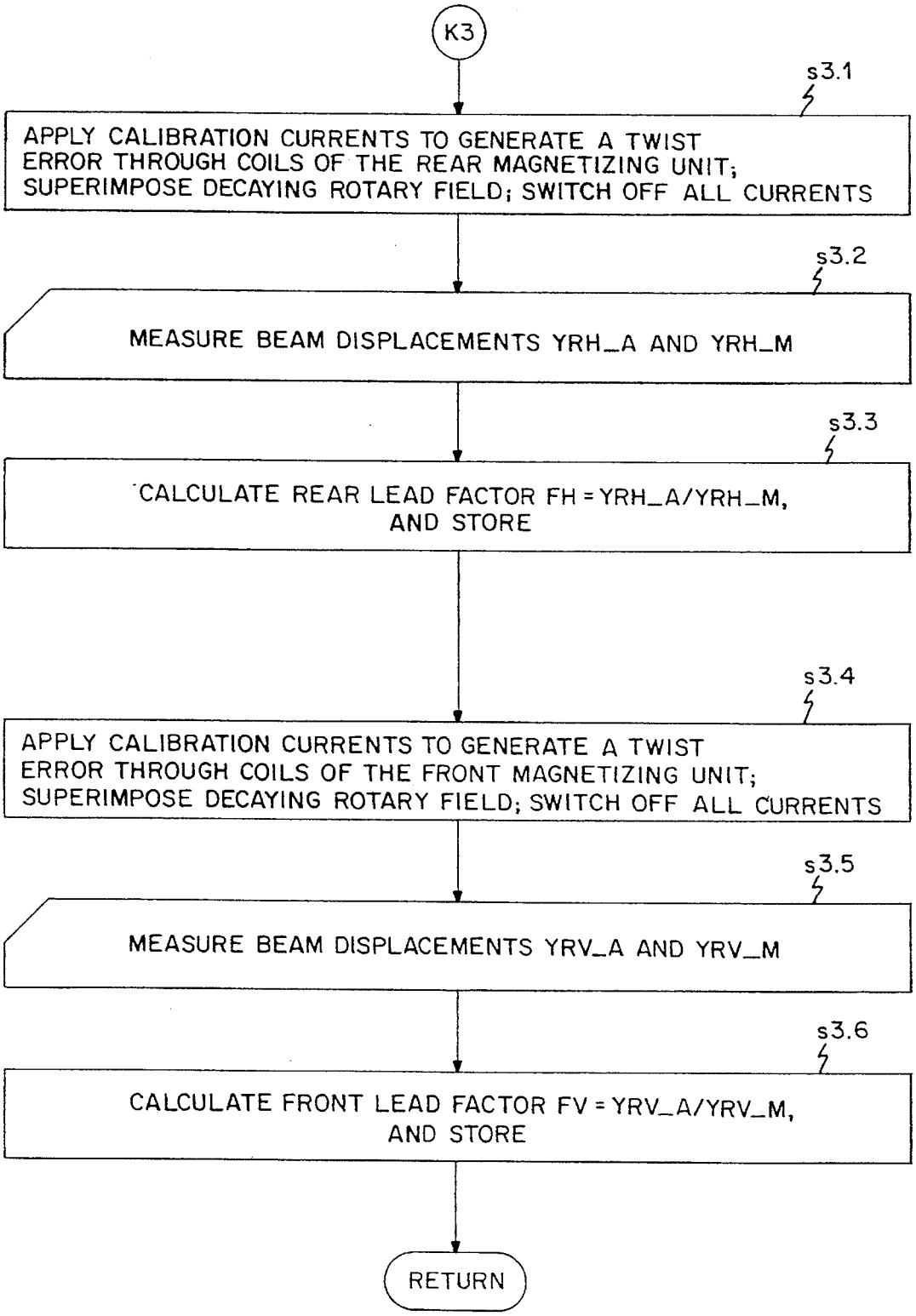

FIG. 4*b* expands calibration step s3 of FIG. 2 into six individual steps s3.1 to s3.6. Since these individual steps are labeled in detail in FIG. 4*b*, reference will be made to FIG. 4*b* in discussing their content. It should be noted here that the value YRH_A denotes the deviation of beam R in the y direction, as caused by the rear magnet ring and measured at the outer edge of the calibration tube. The value YRH_M is the corresponding value measured at the center of the tube. The same applies accordingly to the values YRV_A and YRV_M in step s3.5, which refer to effects of the front rather than the rear magnet ring.

Figure 5A:
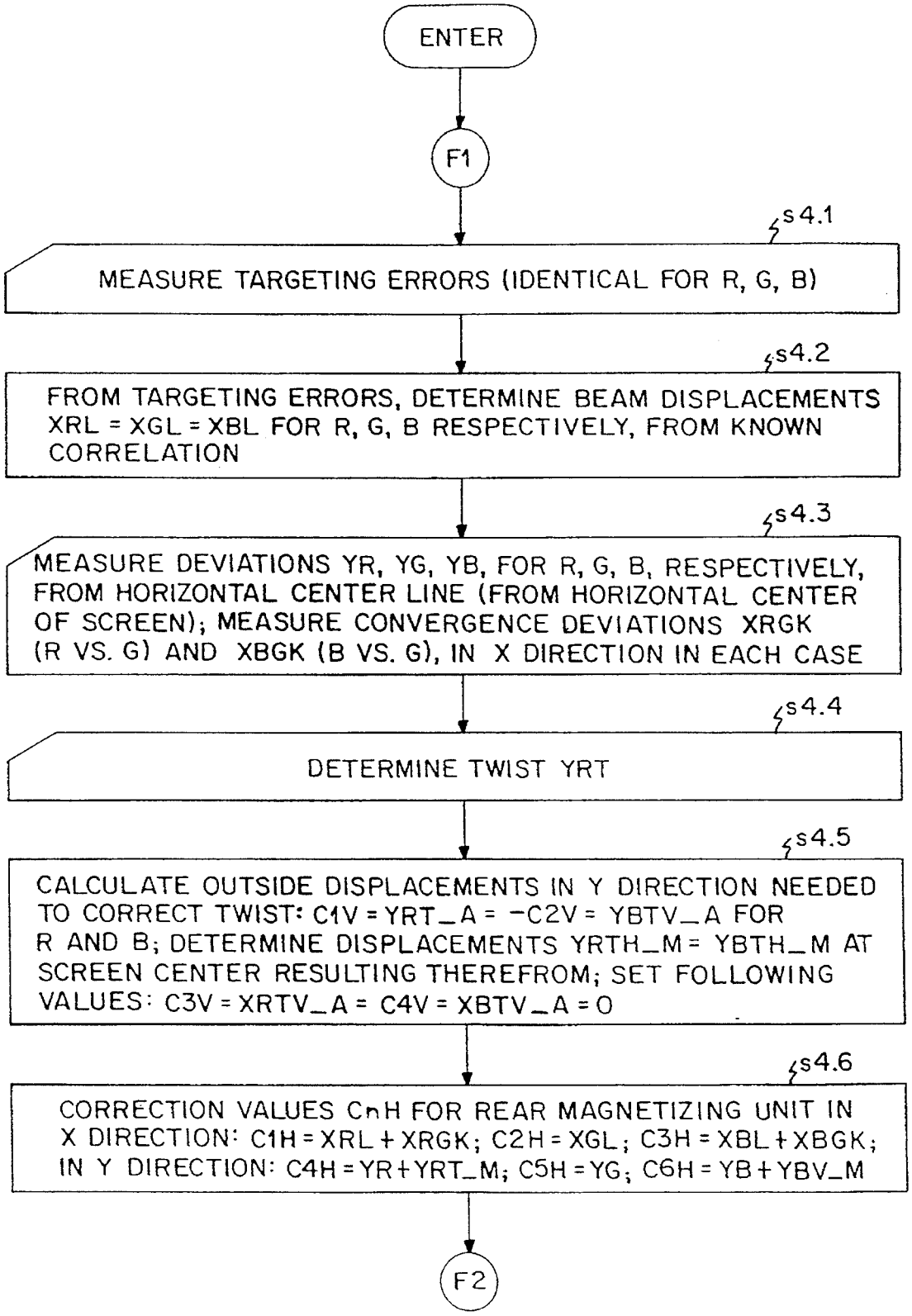
FIGS. 5*a* and 5*b:* Detailed flow diagram for the sequence according to FIG. 3.
Figure 8:
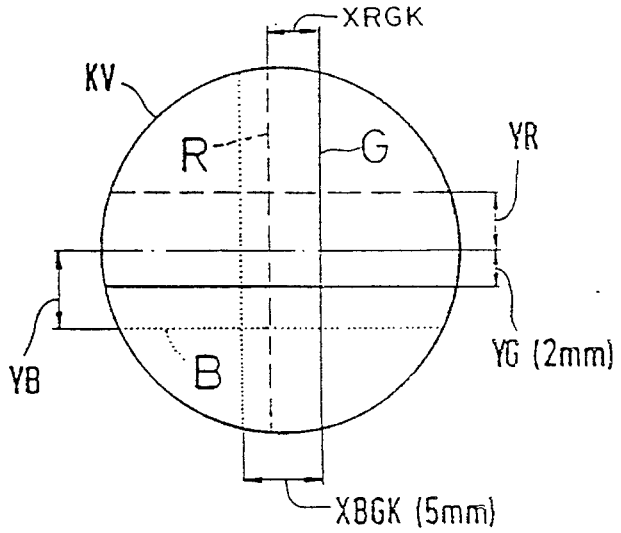
FIG. 8 (PRIOR ART)
FIG. 8: Depiction to explain how a convergence error and a vertical raster offset are measured.
Figure 9A:
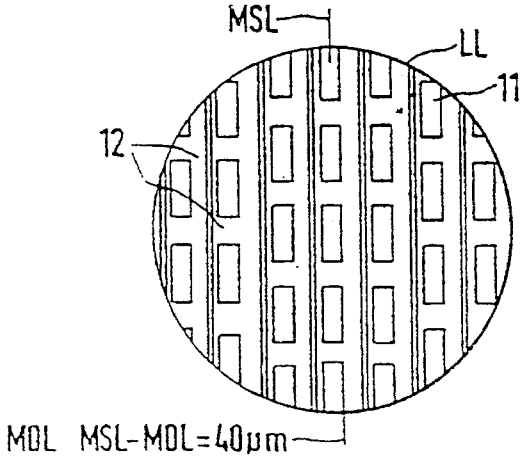
FIG. 9A (PRIOR ART)
FIGS. 9*a* and 9*b:* Depiction to explain how a targeting error is measured.
Figure 9B:
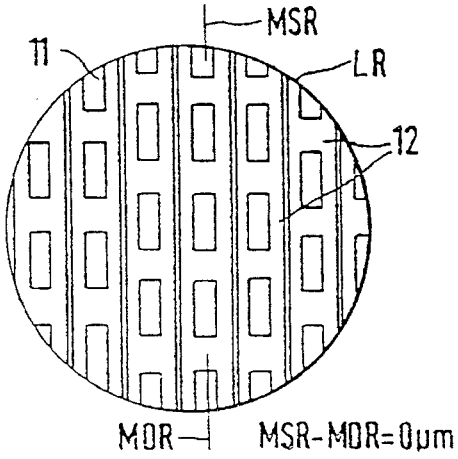
FIG. 9B (PRIOR ART)
Figure 11:
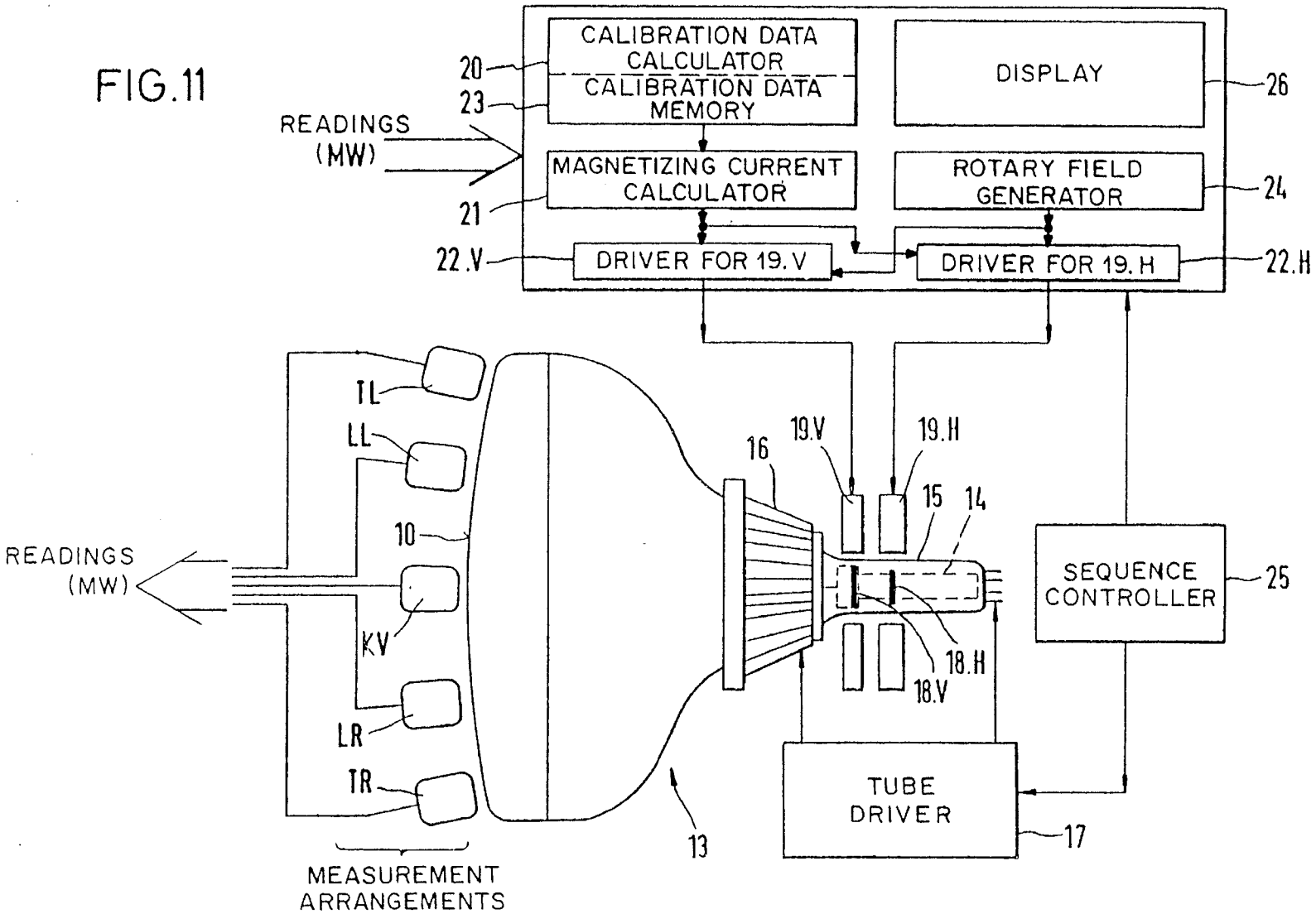
FIG. 11 also applies to the invention, although with different functions for various arrangements)

FIG. 5*a* shows an expansion of step s4 of FIG. 3 into six individual steps s4.1 to s4.6. As far as the content of steps s4.1 to s4.3 is concerned, reference is made to the detailed descriptions in FIG. 5*a*, and the explanations of FIGS. 8 and 9.

In step s4.4 the twist YRT, as depicted in FIG. 10*c*, is determined, specifically the deviation, resulting from the twist error, of the beam R in the y direction at an outer edge. To correct this deviation, displacements must be determined in a special manner, which is done in step s4.5. FIGS. 6*a*, *b*, and *c* will now be explained in order to illustrate step s4.5.

Figure 6:
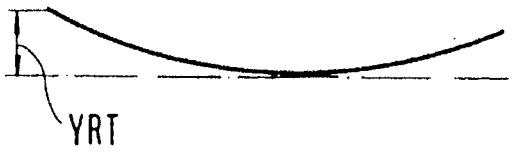
FIGS. 6*a, b,* and *c:* Schematic diagram to explain how automatic twist correction is performed according to the invention.
Figure 6:
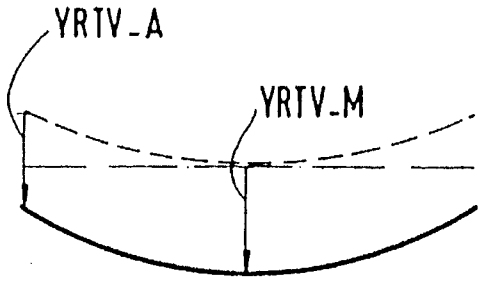
Figure 6:
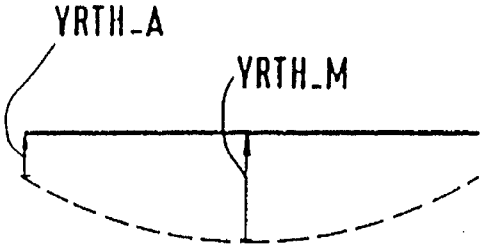
Figure 7:
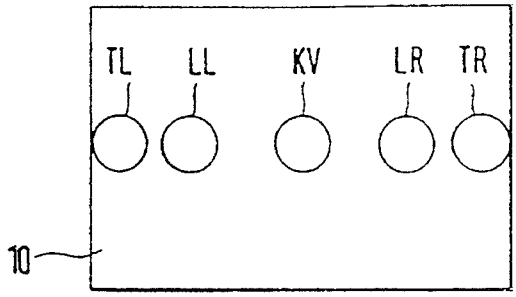
FIG. 7 (PRIOR ART)
FIG. 7: Schematic depiction to explain various measurement locations.

FIG. 6*a* illustrates a pure twist error for beam R. The horizontal pattern line generated by this beam coincides with the horizontal center line H only at the center of the tube, while at the two outer edges it is higher by a value YRT. If an outer point is then displaced downward by the value YRTV_A, the center moves downward over a distance YRTV_M, with these two magnitudes constituting the ratio FV determined in calibration step s3.6. This relationship is reproduced by equation (1) in FIG. 6, and illustrated in FIG. 6*b*. The downward displacement YRTV_A is larger than necessary to correspond to the twist error YRT, which in the example goes upward. This produces a "lead" that is later canceled out by magnetization of the rear magnet ring. To do so, as illustrated in FIG. 6*c*, the outer point of the raster line is displaced upward over a distance YRTH_A. This results at the center in a larger displacement, namely over the distance YRTH_M, with the ratio between the two distances corresponding to the ratio FH determined in calibration step s3.3. The relationship according to equation (2) in FIG. 6 therefore applies. In the exemplary embodiment, FV is approximately equal to 0.8, and FH approximately equal to 0.4.

The twist error is precisely corrected when equations (3) and (4) according to FIG. 6 are satisfied; these state that the difference between the displacements first downward and then upward correspond exactly to a displacement downward equal to the twist error, and that the downward and upward displacements in the center must precisely cancel one another. Reformulating equations (1) to (4) yields equations (5) and (6), from which lastly we obtain a value YRTH_M in an equation (7). This value refers to the displacement of the beam R in the y direction required to correct the twist T by magnetizing the rear magnet ring 18.H at the center M of the screen, when that same beam is displaced at the outer edge, by magnetization of the front magnet ring 18.V, by a value YATV_A. The corresponding values for beam B are equal in magnitude but opposite in sign.

In step s4.5, therefore, the value YRTV_A is determined from the twist error YRT measured in step s4.4. The said value is used as a first correction value T1V. This is a correction that is effected by the front magnet ring 18.V. The second correction value C2V is equal in magnitude to the first, but of opposite sign. This is the displacement YBTV_A required for beam B. From these values, the resulting displacements YRTH_M and YBTH_M for the center of the screen are determined using the sequence illustrated with reference to FIG. 6. In addition, two further correction values C3V and C4V are each set to zero; these are intended to represent the values XRTV_A and XBTV_A, respectively, in other words the displacements of the two outer beams in the x direction caused by magnetization of the front magnet ring to correct the twist T. This choice for the outer beams in the x direction depends on the corresponding choice made in calibration step s2.3.

Using the values determined in steps s4.2, s4.3, and s4.5 for the displacements that are to be effected by the rear magnet ring, correction values C1H to C6H are then calculated in step s4.6, as listed in that step.

The sequence of steps s4.1 to s4.6 thus defines six correction values CnH that apply to the rear magnet ring, and four correction values CnV that apply to the front magnet ring. Steps s5.1 to s5.8 illustrate how magnetizing currents for the rear magnetizing unit 19.H are calculated from these correction values.

In step s5.1, six equations (one for each of the six correction values C1H to C6H) are constructed. Each correction value results from the sum of individual corrections caused by the eight individual coil currents i1H to i8H. The way in which a particular coil current, identified by the index m, acts on a particular one of the three beams in one of the two directions, identified by the index n, is defined by the sensitivities EmnH obtained in calibration step s1.4. Since eight currents need to be determined, but only six correction values are available, values for two currents are predefined from a value table. In the exemplary embodiment, these are values for currents i3H and i7H. The equation system for the six currents i1H, i2H, i4H, i5H, i6H, and i8H can now be solved, which is done in step s5.2. The total magnetization power required with these magnetizing currents is calculated, and the calculated value is stored (step s5.3). In a subsequent step s5.4, the program examines whether all the values for the currents i3H and i7H from the value table have been processed. If this is not the case, the next values for these two currents are read out in a step s5.5, and steps s5.2 to s5.4 are repeated. When the entire table has finally been processed, the program identifies (in step s5.6) the solution which resulted in minimum power output. The corresponding values for the eight magnetizing currents imH are stored.

The four magnetizing currents imV for the front magnetizing unit 19.V still remain to be determined. This is relatively simple, since four readings are available for four coils. The four equations for the currents are constructed in a step s5.7, in the same way as the six equations were in step s5.1. The equation system is solved, and the values for the magnetizing currents imV corresponding to the equation are stored (step s5.8).

Figure 5B:
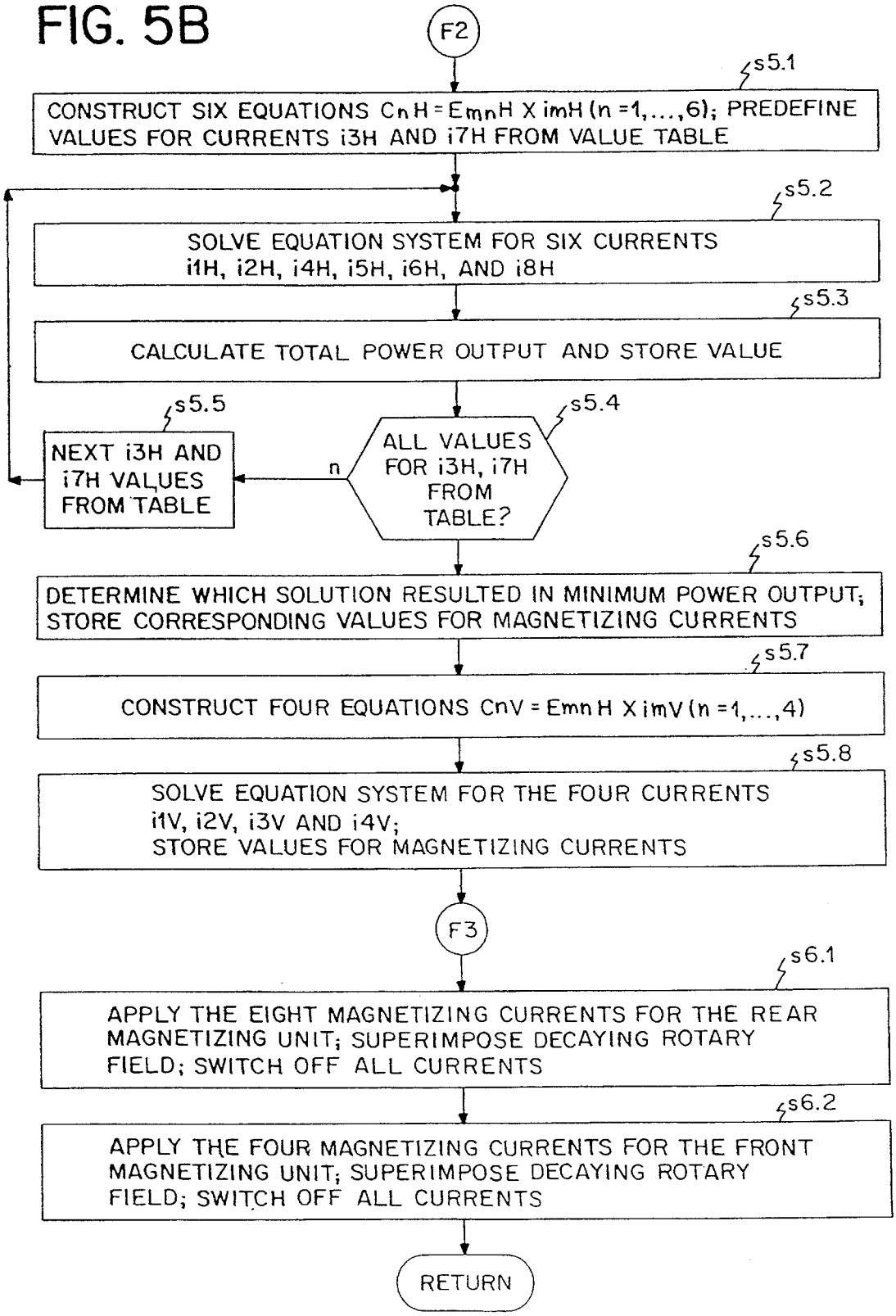

All that now remains is to perform step s6. This is done, as shown in FIG. 5*b*, in two substeps s6.1 and s6.2. In step s6.1, the magnetizing currents imH are applied to the rear magnetizing unit 19.H, a decaying magnetic field is superimposed, and all the currents are switched off when the amplitude of the rotary field falls below a threshold. The values that apply correspond entirely to those of the calibration procedure. In step s6.1, the currents imV are correspondingly applied to the front magnetizing unit 19.V, and magnetization occurs by means of a decaying rotary field. Here again, the values correspond to those used during calibration. It should be mentioned at this point that the front rotary field is generated with higher currents, i.e. starting at about 60 A.

The exemplary embodiment described above can easily be simplified by omitting all process steps that have to do with automatic twist correction. The twist is then not corrected at all, as is customary with a number of manufacturers, or it is corrected manually with a certain "aiming lead," and the residual correction is made with the remaining process steps.

If twist correction is made automatically, but if it can be less precise than in the exemplary embodiment mentioned above, it is sufficient to measure a single twist deviation, and from this to calculate a single correction current. This current is then sent through the coils W1V and W2V so that they generate magnetic poles in The same direction, while a .current of equal strength is sent through the coils W3V and W4V in such a way that poles in the opposite direction are produced.

The design of the magnetizing units depends greatly on practical circumstances. For example, four coils (rather than only two located in the vertical plane) are used for the front magnetizing unit 19.V, since with four coils the heat produced during magnetization can be dissipated better than with only two coils. In the case of the rear magnetizing unit 19.H, eight coils rather than six are used, since then all errors can be corrected with magnetizing currents that are reasonably attainable in practical terms. Theoretically, six coils, controllable independently of one another, would be sufficient to correct the six possible beam deviations. With symmetrically arranged coils, however, this would require almost infinite magnetizing currents if different deviations were present. This difficulty could be overcome with six asymmetrically arranged coils, but extra space would then be needed. However, the space around the tube neck must be utilized as well as possible so that the necessary magnetic fields can be produced with reasonable outlay. It has been found that an arrangement of eight coils represents a sensible solution in practice.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. Process for magnetizing a magnet ring in the neck of a color picture tube with a plurality of electron beams, hereafter called a production tube, with the said magnetization occurring by means of a magnetizing unit and comprising the following sequences:

calibrate the magnetizing unit having m coils using a calibration tube, so as to determine which currents through the magnetizing unit cause which beam displacements;

measure deviations between beam positions and reference positions;

calculate magnetizing currents for the magnetizing unit based on the measured deviations and the calibration values, so that magnetization of the magnet ring using the magnetizing currents will deflect the beams into the reference positions; and magnetize the magnet ring using the magnetizing currents; wherein the calibration sequence is as follows:

operate a respective coil m with a calibration current $i_m$, in order to generate a calibration magnetizing field;

impress the magnetic field generated by the respective coil into the magnet ring of the calibration tube by means of an auxiliary field that has essentially the same profile in time and space as one that is used to magnetize the magnet ring of a production tube;

measure the beam displacements Sn of all the electron beams for two directions perpendicular to one another, these beam displacements being produced by magnetization of the previously unmagnetized magnet ring;

calculate the adjustment sensitivity Emn for each electron beam, in each case for the two spacial directions perpendicular to one another, with $Emn=S_n i_m$;

the measurement sequence comprises measuring the beam deviations of all the beams of said production tube from a respective reference position, in the two spacial directions that are perpendicular to one another;

the calculation sequence for the magnetizing currents takes place by linear superimposition of the individual currents required, on the basis of the adjustment sensitivities, to move each of the beams into its reference position; and the magnetization sequence is performed by operating the coils with the calculated magnetizing currents in order to generate an applied magnetizing field; and generating an auxiliary field whose amplitude decreases over time and whose position in time and space changes so that averaged over time, it acts essentially identically, with regard to impression of the applied magnetizing field into the magnet ring of the production tube, in all spacial directions of that field.

2. Process according to claim 1, wherein what is used as the auxiliary field is a rotary field with an amplitude that decays over time, which is generated by means of the magnetizing unit in such a way that the currents to generate the rotary field are overlaid on the magnetizing currents.

3. Process according to claim 2, wherein the magnetizing currents are calculated so that minimum magnetizing power output results.

4. Process according to claim 2, wherein if the number ZS of magnetizing coils is greater than twice the number of ZE of electron beams that can be adjusted independently of one another, the magnetizing currents are predefined for ZS—2× ZE coils.

5. Process according to claim 2, wherein when two magnet rings inside the neck of a color picture tube are to be magnetized by means of two magnetizing units, the procedure is as follows:

during calibration, each of the two magnetizing units is examined to determine the extent to which a beam displacement in the y direction at an outer edge of the calibration tube, caused by magnetization of the magnet ring that was just magnetized, leads to displacement of that same beam in the y direction at the center of the tube;

an additional measurement is made on the production tube to determine how far a beam is deviating in the y direction from its reference position at one outer edge;

a determination is made as to how far that beam needs to be displaced in the y direction at the outer edge, by magnetizing the one magnet ring using the one magnetizing unit, so that after magnetization of both magnet rings, the beam occupies its reference position both at the outside and in the center;

the displacement in the y direction for the center resulting from this displacement at the outer edge is determined, using the calibration results for the purpose; and in calculating the applied currents for the other magnetizing unit, the aforesaid required beam displacements are not used directly; instead, values are used that are obtained by adding to these beam displacements for the respective beam the aforesaid resulting displacements in the y direction for the center.

6. Device for magnetizing a magnet ring (18.H) in the neck (15) of a color picture tube (13) with a plurality of electron beams, hereafter called a production tube, with a calibration arrangement (20) to calibrate a magnetizing unit (19.H) having m coils by means of a calibration tube so as to determine which currents through the magnetizing unit cause which beam displacements;

a calculation arrangement (21) to calculate magnetizing currents for the magnetizing unit on the basis of the measured deviations and the calibrated values, so that magnetization of the magnet ring by means of the magnetizing currents will deflect the beams into reference positions; and a driver device (22.H) to drive the magnetizing unit with the magnetizing currents; wherein the calibration carries out a calibration sequence in which:

a respective coil m is operated with a calibration current $i_m$, in order to generate a calibration magnetizing field;

an auxiliary magnetic field generated by the respective coil is impressed into the magnet ring that has essentially the same profile in time and space as an applied magnetizing field that is used to magnetize the magnet ring of a production tube;

beam displacements Sn of all the electron beams for two directions perpendicular to one another are measured, these beam displacements being produced by magnetization of the previously unmagnetized magnet ring;

the adjustment sensitivity Emn for each electron beam is calculated, in each case for the two spatial directions perpendicular to one another, with $Emn=S_n i_m$;

the calculation arrangement performs a calculation sequence according to which magnetizing currents are calculated by linear superimposition of individual currents required, on the basis of the adjustment sensitivities, to move each of the beams into its reference position; and the driver arrangement has means for operating the coils with the calculated magnetizing currents in order to generate the applied magnetizing field; and means for generating the auxiliary magnetic field whose amplitude decreases over time and whose position in time and space changes so that averaged over time, the auxiliary magnetic field acts essentially identically in all spatial directions as the applied magnetizing field that is used to magnetize the magnet ring of the production tube.

7. Process according to claim 1, wherein the magnetizing currents are calculated so that minimum magnetizing power output results.

8. Process according to claim 7, wherein if the number ZS of magnetizing coils is greater than twice the number of ZE of electron beams that can be adjusted independently of one another, the magnetizing currents are predefined for ZS—2× ZE coils.

9. Process according to claim 7, wherein when two magnet rings inside the neck of a color picture tube are to be magnetized by means of two magnetizing units, the procedure is as follows:

during calibration, each of the two magnetizing units is examined to determine the extent to which a beam displacement in the y direction at an outer edge of the calibration tube, caused by magnetization of the magnet ring that was just magnetized, leads to displacement of that same beam in the y direction at the center of the tube;

an additional measurement is made on the production tube to determine how far a beam is deviating in the y direction from its reference position at one outer edge;

a determination is made as to how far that beam needs to be displaced in the y direction at the outer edge, by magnetizing the one magnet ring using the one magnetizing unit, so that after magnetization of both magnet rings, the beam occupies its reference position both at the outside and in the center;

the displacement in the y direction for the center resulting from this displacement at the outer edge is determined, using the calibration results for the purpose; and in calculating the applied currents for the other magnetizing unit, the aforesaid required beam displacements are not used directly; instead, values are used that are obtained by adding to these beam displacements for the respective beam the aforesaid resulting displacements in the y direction for the center.

10. Process according to claim 1, wherein if the number ZS of magnetizing coils is greater than twice the number ZE of electron beams that can be adjusted independently of one another, the magnetizing currents are predefined for ZS—2× ZE coils.

11. Process according to claim 10, wherein when two magnet rings inside the neck of a color picture tube are to be magnetized by means of two magnetizing units, the procedure is as follows:

during calibration, each of the two magnetizing units is examined to determine the extent to which a beam displacement in the y direction at an outer edge of the calibration tube, caused by magnetization of the magnet ring that was just magnetized, leads to displacement of that same beam in the y direction at the center of the tube;

an additional measurement is made on the production tube to determine how far a beam is deviating in the y direction from its reference position at one outer edge;

a determination is made as to how far that beam needs to be displaced in the y direction at the outer edge, by magnetizing the one magnet ring using the one magnetizing unit, so that after magnetization of both magnet rings, the beam occupies its reference position both at the outside and in the center;

the displacement in the y direction for the center resulting from this displacement at the outer edge is determined, using the calibration results for the purpose; and in calculating the applied currents for the other magnetizing unit, the aforesaid required beam displacements are not used directly; instead, values are used that are obtained by adding to these beam displacements for the respective beam the aforesaid resulting displacements in the y direction for the center.

12. Process according to claim 1, wherein when two magnet rings inside the neck of a color picture tube are to be magnetized by means of two magnetizing units, the procedure is as follows:

during calibration, each of the two magnetizing units is examined to determine the extent to which a beam displacement in the y direction at an outer edge of the calibration tube, caused by magnetization of the magnet ring that was just magnetized, leads to displacement of that same beam in the y direction at the center of the tube;

an additional measurement is made on the production tube to determine how far a beam is deviating in the y direction from its reference position at one outer edge;

a determination is made as to how far that beam needs to be displaced in the y direction at the outer edge, by magnetizing the one magnet ring using the one magnetizing unit, so that after magnetization of both magnet rings, the beam occupies its reference position both at the outside and in the center;

the displacement in the y direction for the center resulting from this displacement at the outer edge is determined, using the calibration results for the purpose; and in calculating the applied currents for the other magnetizing unit, the aforesaid required beam displacements are not used directly; instead, values are used that are obtained by adding to these beam displacements for the respective beam the aforesaid resulting displacements in the y direction for the center.

13. The process of claim 1, wherein said production tube is also said calibration tube.

14. The device of claim 6, wherein said production tube is also said calibration tube.

15. Method for magnetizing a magnet ring in a neck of a color picture production tube with a plurality of electron beams, said magnetizing occurring by means of a magnetizing unit and comprising the steps of:

calibrating said magnetizing unit using a calibration tube, by means of an auxiliary field that has essentially a same profile in time and space as one that is used to magnetize said magnet ring of said color picture production tube, for determining magnetizing currents through said magnetizing unit that cause electron beam displacements indicative of an adjustment sensitivity;

measuring deviations between electron beam positions and reference positions;

calculating magnetizing currents for said magnetizing unit based on said deviations and said adjustment sensitivity for magnetizing said magnet ring of said color picture production tube using said magnetizing currents for deflecting said electron beams into said reference positions; and magnetizing said magnet ring for said color picture production tube using said magnetizing currents for generating an applied magnetizing field and impressing an auxiliary field whose amplitude decreases over time and whose position in time and space changes so that averaged over time, it acts essentially identically, with regard to said applied magnetizing field in the magnet ring of said color picture production tube, in all spatial directions of that field.

16. The method of claim 15, wherein said production tube is also said calibration tube.

17. The method of claim 15, wherein said magnetizing unit has m coils and wherein said step of calibrating said magnetizing unit using a calibration tube comprises the steps of:

operating a respective coil m with a calibration current $i_m$ in order to generate a calibration magnetizing field;

impressing said magnetizing field generated by the respective coil into a magnet ring of the calibration tube by means of said auxiliary field;

measuring the beam displacements Sn of all of said plurality of electron beams for two directions perpendicular to one another, said beam displacements being produced by magnetization of a previously unmagnetized magnet ring; and calculating the adjustment sensitivity Emn for each electron beam, in each case for two spatial directions perpendicular to one another, with $Emn=Sn/i_m$.

18. The method of claim 17, wherein said production tube is also said calibration tube.

19. The method of claim 15, wherein said step of measuring comprises the step of measuring deviations of all of said plurality of electron beams of said color picture production tube from a respective reference position, in two spatial directions that are perpendicular to one another.

20. The method of claim 15, wherein said step of calculating magnetizing currents for said magnetizing unit takes place by linear superimposition of individual currents required, on the basis of the adjustment sensitivities, to move each of the beams into its reference position.

* * * * *

UNITED STATES PATENT AND TRADEMARK OFFICE

CERTIFICATE OF CORRECTION

PATENT NO. : 5,466,180
DATED : November 14, 1995
INVENTOR(S) : Hassler et al

It is certified that error appears in the above-indentified patent and that said Letters Patent is hereby corrected as shown below:

At column 11, line 20, please change "$S_n i_m$" to --$S_n/i_m$--.

At column 12, line 51, please change "$S_n i_m$" to --$S_n/i_m$--.

Signed and Sealed this

Twenty-eighth Day of May, 1996

*Attest:*

BRUCE LEHMAN

*Attesting Officer*

*Commissioner of Patents and Trademarks*